US005635974A

United States Patent [19]

Yasutomi et al.

[11] Patent Number: 5,635,974

[45] Date of Patent: Jun. 3, 1997

[54] THERMAL HEAD

[75] Inventors: Tsuyoshi Yasutomi; Kazuhiro Watanabe; Yoshiaki Kutsuzawa; Toshiaki Michihiro; Kennichi Gakuhari, all of Aira-gun, Japan

[73] Assignee: Kyocera Corporation, Kyoto, Japan

[21] Appl. No.: 587,769

[22] Filed: Dec. 21, 1995

[30] Foreign Application Priority Data

Dec. 26, 1994 [JP] Japan ..... 6-322518
Jul. 28, 1995 [JP] Japan ..... 7-193861

[51] Int. Cl.[6] ..... B41J 2/335

[52] U.S. Cl. ..... 347/203

[58] Field of Search ..... 347/203; 428/908.8

[56] References Cited

U.S. PATENT DOCUMENTS 4,835,550 5/1989 Sato et al. ..... 347/203

FOREIGN PATENT DOCUMENTS 0299735 1/1989 European Pat. Off. ..... 347/203
51-56236 5/1976 Japan .
61-229570 10/1986 Japan ..... 347/203
63-216760 9/1988 Japan ..... 347/203
2-292058 12/1990 Japan ..... 347/203
3-222761 10/1991 Japan ..... 347/203
4-197649 7/1992 Japan ..... 347/203
4-232071 8/1992 Japan ..... 347/203

*Primary Examiner*—Huan H. Tran
*Attorney, Agent, or Firm*—Loeb & Loeb LLP

[57] ABSTRACT

A thermal head comprising a resistance heating element and electrodes for feeding electric power to the resistance heating element formed on an insulating substrate, and a protective layer of filler-containing-glass formed so as to cover the resistance heating element and electrodes, wherein the specific gravity of the glass for forming the protective layer is equal to or higher than the specific gravity of the filler. In this manner, while maintaining the smoothness and enhancing the ear resistance of the protective layer surface, the thermal expansion coefficient of the protective layer is decrease to reduce the thermal stress due to pulse heat generation from the resistance heating element, and moreover the thermal conductivity of the protective layer is enhanced, so that a favorable recorded image is obtained for a long period.

3 Claims, 5 Drawing Sheets

THERMAL HEAD

BACKGROUND OF THE INVENTION

1. Field of the Invention

The present invention relates to a thermal head, more particularly to a thermal head having a protective layer excellent in wear resistance.

2. Description of the Related Art

An image recording apparatus of thermal recording system is simple in constitution, which is advantageous for reducing in size and weight and lowering the rice, quiet in recording and small in power consumption, and hence it is widely used in various recording applications including a variety of printers and fax machines.

The thermal head used in such a thermal recording system comprises, for example in the case of line head, a heating unit having resistance heating elements formed in a line on an electrically insulating substrate, and electrodes connected to the resistance heating elements. The heating unit is brought into contact with recording paper direct or through a recording medium such as an ink ribbon, and recording information is sequentially entered as electric signals into each resistance heating element via electrodes, thereby recording in the principal scanning direction. At the same time the recording paper travels for recording in the sub-scanning direction, so that a two-dimensional recorded image is obtained.

As such thermal head, the structure as shown in FIG. 5 has been hitherto known. FIGS. 5A through 5C show an example of line head, FIG. 5A is a plan view, and FIGS. 5B and 5C are essential sectional views taken from plane A—A, In a thermal head 1 shown in FIGS. 5A through 5C, reference numeral 2 denotes an electrically insulating substrate made of glazed ceramic, and a glaze layer 2*b* is formed on a ceramic substrate 2*a*. On this insulating substrate 2 are formed a resistance heating element 3 of ruthenium oxide or the like, and electrodes 4 of gold (Au) or the like, which are formed by combination of a process of forming each layer and a photolithographic process. By forming such fine patterns of electrodes 4 on the resistance heating element 3 and selectively applying an electric power between the electrodes 4, the resistance heating element 3 between the electrodes 4 can be heated in tiny dots. A protective layer 5 is formed so as to cover the resistance heating element 3 and the electrodes 4. As shown in FIG. 5B, the resistance heating element 3 and the electrodes 4 may be formed in such a manner that the electrodes 4 are formed on the resistance heating element 3 and then windows are opened in the electrodes 4 by etching so that the resistance heating element 3 between the electrodes 4 is heated in tiny dots. As also shown in FIG. 5C, reversing the order of forming and laminating, the resistance heating element 3 may be formed on the electrodes 4 in which the process of opening windows has already been conducted, so as to be heated in tiny dots.

As to the protective layer 5 in the thermal head 1 of such constitution, in order to enhance the durability, not only high wear resistance to withstand sliding contact with the recording paper is demanded, but also high smoothness of the surface, that is, small surface roughness is required so as to obtain a favorable image quality by enhancing the features with respect to contact and slip with the recording paper and so as to reduce abrasion of the layer 5. So far, as such protective layer 5, a layer of high hardness obtained by a sputtering method, CVD (chemical vapor deposition) method or other thin film forming technique has been used.

However, the film forming speed is slow, and consequently it takes a long time to form the layer. Additionally a film forming apparatus is expensive, resulting in high manufacturing cost.

By contrast, as an inexpensive protective layer 5 made of glass obtained by a thick film forming technique such as printing and baking has been also used widely. The glass of this protective layer 5 contains fillers such as alumina ($Al_2O_3$) particles in order to decrease the thermal expansion coefficient of the glass to reduce thermal stress applied to the resistance heating element, to strengthen the wear resistance of the layer 5 and to enhance the thermal conductivity.

Concerning such a protective layer 8 made of glass, for example, Japanese Unexamined Patent Publication JPA 51-56236 (1976) proposes a thermal head comprising a resistance heating element formed on a substrate and electrodes coupled to the resistance heating element, wherein at least the portion of the thermal head contacting with recording paper is coated with low melting point glass such a lead glass, and the glass layer contains a fine granular or a fibrous material such as diamond, quartz and alumina superior in wear resistance to glass. Additionally, in order to prevent oxidation of the thermal head and diffusion of the resistance heating element into the glass at the time of glass coating, it is proposed to interpose an insulating film such as $SiO_2$ and $SiO.Ta_2O_5$ between the resistance heating element and the glass coating and between the electrodes and the glass coating. By such coating, the wear resistance is improved without lowering the characteristics of the thermal head, so that the life of the thermal head can be extended.

Japanese Unexamined Patent Publication JPA 63-216760 (1988) proposes a thick film type thermal recording head composed by sequentially laminating a layer of thermal resistance layer and electrodes, a resistance heating element layer, and a protective layer on an insulating substrate, wherein the protective layer comprises a lower layer of alumina-filler-containing-glass, the lower layer facing the resistance heating element layer, and an upper layer of amorphous glass having an alumina filler content of zero or smaller than in the glass layer, formed at the outer side of the glass layer. As a result, the surface smoothness of the upper layer is made smaller than 0.2 μm, and even if any wear, crack or flaw is formed on the glass of the upper layer, it is arrested by the glass of the lower layer and is not propagated downward, and hence there is no effect on the heating resistance element, thereby enhancing the reliability of the thermal head and extending the life time.

Japanese Unexamined Patent Publication JPA 2-292058 (1990) proposes a thick film type thermal head comprising an under-glaze-layer formed on an insulating substrate, both a heating resistance element and electrodes for energizing the heating resistance element formed on the under-glaze-layer, and an overcoat layer for covering the heating resistance element, wherein the overcoat layer is composed of a first overcoat layer formed by a thick film forming technique, and a second overcoat layer formed thereon by the thin film forming technique. The first overcoat layer is formed by printing and baking glass paste, and on the first overcoat layer is formed a second overcoat layer made of SiAlON, $Ta_2O_5$, or SiC by a thin film forming technique such as sputtering or vacuum deposition. According to this constitution, since a material of high hardness is used in the second overcoat layer, and its surface is smooth, so that the wear resistance may be enhanced without sacrificing the printing quality.

Furthermore, Japanese Unexamined Patent Publication JPA 4-232071 (1992) discloses a thermal head comprising a glaze layer formed on a substrate, a heating resistance element layer formed on this glaze layer, a power feeding layer for feeding electric power to the heating resistance element layer, and a protective layer formed on the power feeding layer and heating resistance element layer, wherein the protective layer is made of glass containing fillers, and the mean article size of the fillers exists within a range of 1 μm to 2 μm. Using $SiO_2$—PbO—$Al_2O_3$—CdO as a glass material and adding 25% fillers of α—$Al_2O_3$having a mean particle size of 1.3 μm, the surface roughness Ra≦0.1 μm can be achieved without lowering the Knoop hardness, and a thermal head having a protective layer excellent in surface smoothness and hardness can be obtained, so that printing of high quality with less paper flaw is achieved.

Japanese Unexamined Patent Publication JPA 61-229570 (1985) discloses a thermal head comprising a glazed substrate, both a heating element and an electric conductive layer provided on the glazed substrate, and a wear resistant glass layer formed thereon, wherein the wear resistant glass layer is formed on the heating element and electric conductive layer via a thin oxide film of silicon oxide, alumina or the like having a thickness of at least 300 angstroms. JPA 61-229570 also discloses that the thin oxide film of silicon oxide is formed by the CVD method, and one of alumina is formed by the sputtering method, and that lead borate glass (PbO—$SiO_2$—$B_2O_3$) to which a slight amount of alumina and potassium oxide ($K_2O$) was added is printed and baked to form the wear resistant glass. As a result, the adhesion strength between the glass layer and the heating resistance element can be enhanced, while oxidation of the heating resistance element at the time of glass baking can be prevented, and moreover the impurity ions in the glass are prevented from diffusing into the heating resistance element to change the resistance value of a heating portion.

However, the present inventors investigated the protective layers disclosed in the above publications, and found that the following problems are still present even in the constitutions disclosed in the above publications.

That is, in the coating of JPA 51-56236, since the size of the filler is not taken into consideration, the filler may project from the surface of the coating to increase the surface roughness, namely lower the surface smoothness, resulting in lowering the printing quality, or damaging the paper. When the specific gravity of the glass is smaller than that of the filler, the filler sinks into the bottom of the coating to be distributed unevenly, and hence the wear resistance of the surface is not enhanced.

In the protective layer of JFA 4-232071, when the mean particle size of the filler is set larger than usual, since the specific gravity of the filler in comparison with the glass of the protective layer is not taken into consideration, if the specific gravity of glass is larger than that of the filler, the filler of large particle size may float to the surface of the protective layer to be distributed unevenly, resulting in increasing the surface roughness, and lowering the printing quality like JPA 51-56236. Likewise, when the specific gravity of the glass is smaller than that of the filler, the filler sinks into the bottom of the coating to be distributed unevenly the same as above, and hence the wear resistance of the surface cannot be enhanced.

Further, in the case of two-layers structure of the protective layer as disclosed in JPA 63-216760 or JPA 2-292058, although the surface of the protective layer is satisfactorily smooth, it is hard to obtain sufficient adhesion between the two layers or resistance against thermal stress, and the number of processes of protective layer fabrication increases with the result that the material and fabrication cost increases.

Moreover, as in JPA 61-229570, in the case where a thin oxide film is interposed between the heating element and the wear resistant glass layer and between the conductive layer and the wear resistant glass layer, since oxygen is present in the thin oxide film layer, sufficient oxidation preventive effect can not be attained by the heating element having a thickness not much exceeding about 300 angstroms.

SUMMARY OF THE INVENTION

In the light of the above problems, the present invention is completed as a result of intensive studies by the present inventors, and it is hence a primary object of the invention to provide a highly reliable thermal head comprising a protective layer made of filler-containing-glass, wherein the dispersion and distribution properties of the filler contained in the glass are improved to enhance the wear resistance while keeping the smoothness of the protective layer surface, and the thermal expansion coefficient of the protective layer is decreased to reduce the thermal stress by pulse heat generation from the resistance heating element, and moreover the thermal conductivity of the protective layer is improved, so that an excellent quality of recorded image may be obtained for a long period.

It is another object of the invention to provide a highly reliable thermal head capable of stably obtaining an excellent recorded image quality, without causing oxidation or deterioration in the resistance heating element even by forming a protective layer of filler-containing-glass.

It is a further object of the invention to provide a highly reliable and inexpensive thermal head by forming a protective layer of low cost having excellent wear resistance and stable characteristics.

The invention provides a thermal head comprising a resistance heating element and electrodes for feeding electric power to the resistance heating element formed on an electrically insulating substrate, and a protective layer composed of filler-containing-glass formed so as to cover the resistance heating element and the electrodes, wherein the specific gravity of the glass for forming the protective layer is equal to or higher than that of the filler.

It is preferable in the invention that a deterioration preventive layer formed of an oxide and/or a nitride is interposed between the resistance heating element and the protective layer and between the electrodes and the protective layer.

The invention also provides a thermal head comprising a resistance heating element and electrodes for feeding electric power to the resistance heating element formed on an electrically insulating substrate, and a protective layer of filler-containing-glass formed so as to cover the resistance heating element and the electrodes, wherein the filler in the protective layer is contained more in the upper half region than in lower half region in the thickness direction of the protective layer.

According to the thermal head of the invention, by setting the specific gravity of the glass for forming the protective layer to be similar to that of the filler, the filler is evenly dispersed in the glass paste in printing and baking to be distributed uniformly, and therefore the filler is evenly dispersed and uniformly distributed in the glass layer, and hence the thermal expansion coefficient and thermal conductivity of the protective layer are improved to be uniform, and as well a proper amount of filler is distributed near the surface of the protective layer, so that the wear resistance may be enhanced, Besides, by setting the specific gravity of the glass for forming the protective layer larger than that of the filler, the filler is distributed more on the surface side in the glass paste in printing and baking, and hence the filler is distributed more on the surface side than in the bottom of the glass layer, thereby remarkably enhancing the wear resistance of the protective layer to sliding on the recording paper.

For example, when alumina particles are used as the filler, since the specific gravity of alumina is about 3.9, the specific gravity of the glass is preferably set to 3.9 or more, and when using lead borate glass as the glass, the content of PbO in the glass is preferably 45% or more.

As mentioned above, when the filler is distributed more near the surface of the protective layer, by properly setting the particle size of the filler, an excellent smoothness is obtained without impairing the surface roughness of the protective layer, so that a favorable recorded image quality can be attained.

Moreover, since the protective layer is formed by the thick film forming technique such as printing and baking, it is possible to form easily in a shorter time as compared with the protective layer formed by the thin film forming technique, and hence a highly reliable protective layer is obtained at low cost.

Still more, by interposing a deterioration preventive layer formed of oxide and/or nitride such as $SiO_2$ and SiN.SiAlON having a thickness thicker than a specified thickness, between the resistance heating element and the protective layer and between the electrodes and the protective layer, the resistance heating element is prevented from being oxidized and deteriorated due to reaction with glass components when forming the protective layer by printing or baking, so that a thermal head of stable characteristics and high reliability may be provided.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1A:
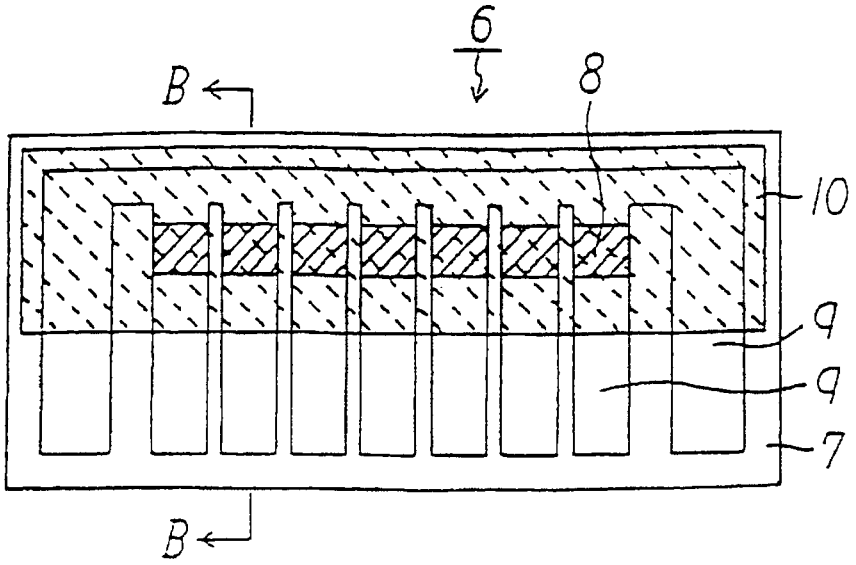
FIG. 1A is a plan view showing the constitution of an embodiment of a thermal head of the invention.

No referring to the drawings, preferred embodiments of the invention are described below.

Figure 1B:
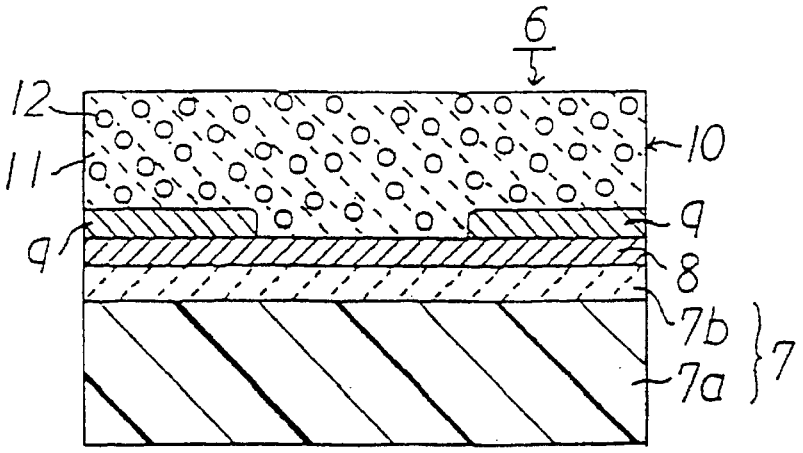
FIGS. 1B and 1C are essential sectional views taken along plane B—B.
Figure 1C:
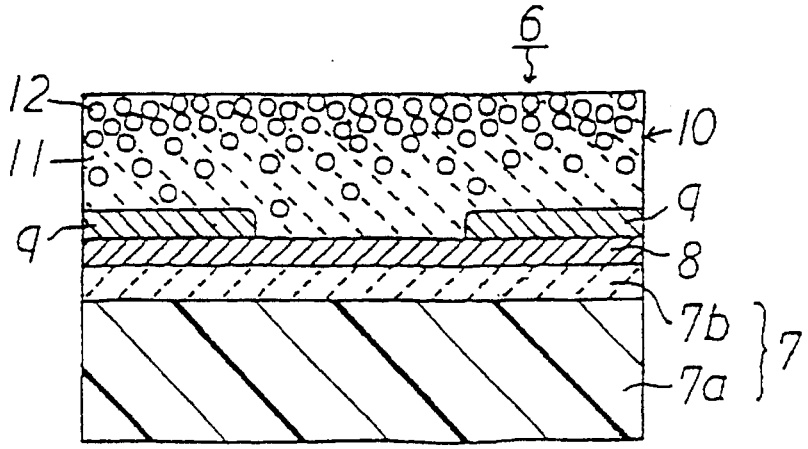
Figure 5A:
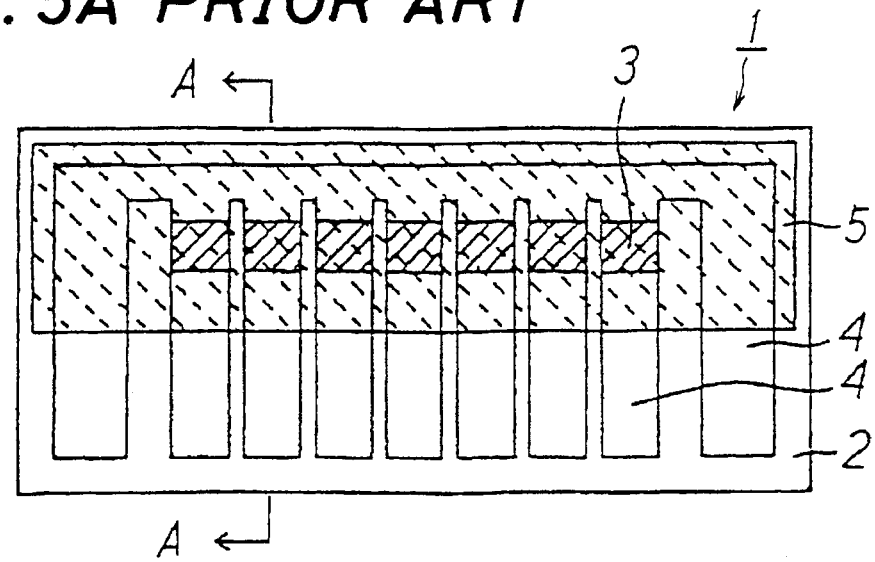
FIG. 5A PRIOR ART
FIG. 5A is a plan view showing the constitution of a conventional thermal head.
Figure 5B:
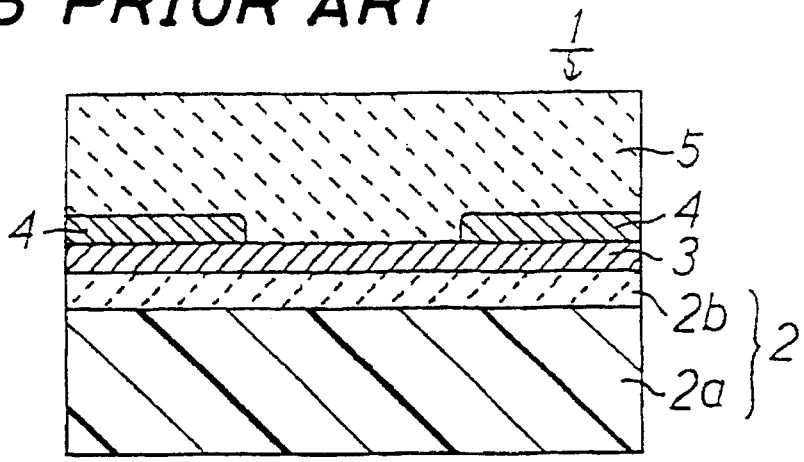
FIG. 5B PRIOR ART
FIGS. 5B and 5C are essential sectional views taken along plane A—A.

The constitution of an embodiment of a thermal head of the invention is shown in FIGS. 1A through 1C. FIGS. 1A through 1C show an example of a line head similar to the one in FIGS. 5. FIG. 1A is a plan views, and FIGS. 1B and 1C are essential sectional views taken along of its section B—B.

Figure 5C:
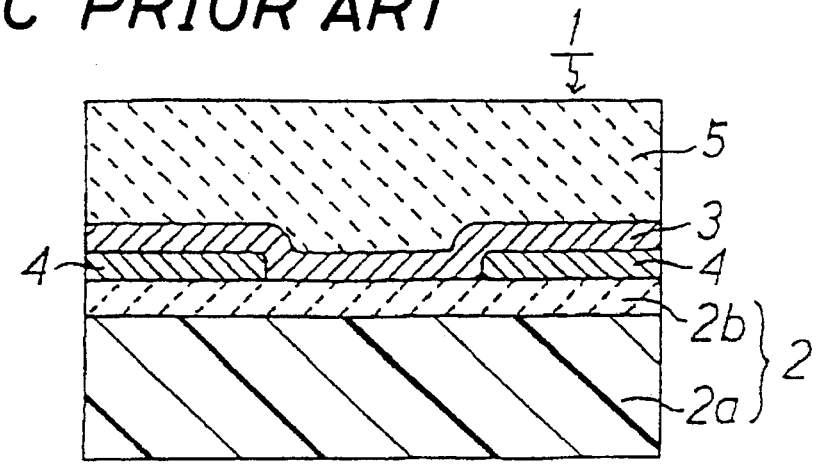
FIG. 5C PRIOR ART

In a thermal head 6 in FIGS. 1A through 1C, reference numeral 7 denotes an electrically insulating substrate composed of lazed ceramic, and a glaze layer **7*b* is formed on a ceramic substrate 7*a* in this embodiment. On this insulating substrate 7, a resistance heating element 8 of ruthenium oxide or the like, and electrodes 9 composed of gold (Au) or the like are formed in the similar constitution as in FIG. 5B by combination of the film forming process of each layer and the photolithographic process or the like. In this way, by forming fine patterns of electrodes 9 on the resistance heating element 8 and applying electric power selectively between the electrodes 9, the resistance heating element 8 between the electrodes 9 can be heated in tiny dots. Incidentally, the resistance heating element 8 and electrodes 9 may be formed in reverse order of forming and laminating as shown in FIG. 5C. Moreover, the resistance heating element 8 may be formed corresponding to pixel density as independent heating elements or a continuous resistance heating element layer. A protective layer 10 is formed thereon so as to cover the resistance heating element 8 and electrodes 9. The protective layer 10 is formed of filler-containing-glass in which filler 12 such as alumina is dispersed in glass 11** mainly containing silicon oxide and lead oxide.

The specific gravities of the glass 11 and filler 12 for forming the protective layer 10 are set so that the specific gravity of the glass 11 may be almost equal to or larger than that of the filler 12. As a result, when the specific gravity of the glass 11 is almost equal to the specific gravity of the filler 12, as shown in FIG. 1B, the filler 12 does not sink into the bottom of the protective layer 12 and exists evenly. Even near the surface over the entire protective layer 10, a proper amount of the filler 12 exists uniformly and therefore a favorable wear resistance is obtained, and the thermal expansion coefficient of the protective layer 10 is suppressed to reduced thermal stress, and further the thermal conductivity of the protective layer 10 can be enhanced.

Moreover, when the specific gravity of the glass 11 is larger than that of the filler 12, the filler 12 of higher hardness is distributed more in the upper half region than in the lower half region of the protective layer 10 in the thickness direction thereof as shown in FIG. 1C, and is especially concentrated near the surface. Hence, the wear resistance of the protective layer 10 to sliding on the recording paper can be notably enhanced, It i preferable that 70% or more of the filler 12 in the protective layer 10 is distributed in the upper half region of the protective layer 10 in the thickness direction thereof, and by thus distributing, the shearing stress caused by friction with recording paper in printing can be favorably alleviated in the lower half region of the protective layer 10 in the thickness direction thereof where the filler 12 is distributed less.

The insulating substrate 7 of the thermal head 6 of the invention is composed of the glazed ceramics having a glaze layer **7*b* of borosilicate glass or the like formed on the ceramic substrate 7*a* of alumina, mullite, SiN or the like as mentioned above. A plate glass made of borosilicate glass may be also used as the insulating substrate 7**.

As the resistance heating element 8, aside from the ruthenium oxide ($RuO_2$) as noted above, tantalum nitride (TaN), tantalum silicate (TaSiO), tungsten (W), chromium oxide ($CrO_2$), titanium silicate (TiSiO), and others may be used, and it is formed by a thin film forming technique such as various sputtering methods and CVD methods, and a thick film forming technique such as printing and baking.

The thickness of the resistance heating element 8 is set properly depending on desired heating characteristics. This resistance heating element 8 may be formed either as one uniform layer covering on the entire heating element region, or as rows of independent heating elements by the photolithographic process or the like.

Apart from the gold (Au) as noted above, aluminum (Al), copper (Cu) and others may be used as the electrodes 9, which are formed into desired electrode wiring patterns by a combination method of a thin film forming technique such as various sputtering methods and vacuum deposition methods, and the photolithographic process, or a combination of a thick film forming technique such as screen printing and baking, and the photolithographic process. The thickness of the electrodes is usually set around 1 μm.

As the glass 11 for forming the protective layer 10, a glass mainly containing silicon oxide and lead oxide is preferably used, which includes lead borosilicate ($SiO_2$—PbO—$B_2O_3$) glass and lead silicate ($SiO_2$—PbO) glass.

The glass 10 may be formed by employing the known thick film forming technique. Specifically, glass powder having a mean particle size of 1 μm or less and a softening temperature of 490° C. is kneaded with a vehicle to form a paste, which is screen printed, dried for about 30 minutes at a temperature of about 120° C., thereafter pre-baked for about 60 minutes at about 400° C. and finally baked at about 500° C. When the mean particle size of the glass powder is set to 1 μm or less as mentioned above, the glass is easily softened and fluidized when baking, and therefore a smoother glass surface can be obtained. Besides, by pre-baking the glass at a predetermined temperature lower than the softening temperature, if a relatively large foreign matter is mixed in the lass paste, the foreign matter can be blown away by the hot air generated at the time of pre-baking, so that formation of defective film due to invasion of a foreign matter into the protective film 10 can be effectively prevented. Moreover, in order to prevent invasion of a foreign matter into the protective layer 10 more effectively, it is sufficient to heat at about 625° to 530° C. for 1 or 2 minutes after the final baking, so that the foreign matter such as organic matter existing in the protective layer 10 can be completely burned and released outside.

Moreover, in order not to deteriorate the material of electrodes 9 in baring, it is required that the baking temperature be sufficiently lower than the melting point of the material of the electrodes 9. For example, if Al is used as the material for the electrodes 9, the baking temperature of the glass 11 must be lower than 660° C. at maximum because the melting point of Al is 660° C., preferably 600° C. or less because the Al film begins to discolor and deteriorate near the melting point. In order to lower the baking temperature of the glass 11 below 600° C., the softening temperature of the glass is desired to be 550° C. or less. Additionally, since the resistance heating element 8 is heated to about 300° C. in thermal recording, the melting point of the glass 11 must be higher than this level. Still further, a sufficient heat resistance is not guaranteed when using the glass whose baking temperature is 450° C. or below. Therefore, the glass 11 whose baking temperature ranges from 450° to 600° C. is preferably used.

Among the above-mentioned glass materials, in particular, the use of borosilicate glass is advantageous in that the specific gravity of the glass can be changed by varying the PbO content in the composition without varying the characteristics (such as thermal conductivity and wear resistance) of the glass 11 necessary for the protective layer 10, and that because the baking temperature of borosilicate glass range from 450° to 600° C., it can be formed easily by printing and baking without deteriorating the Al electrodes.

Figure 2:
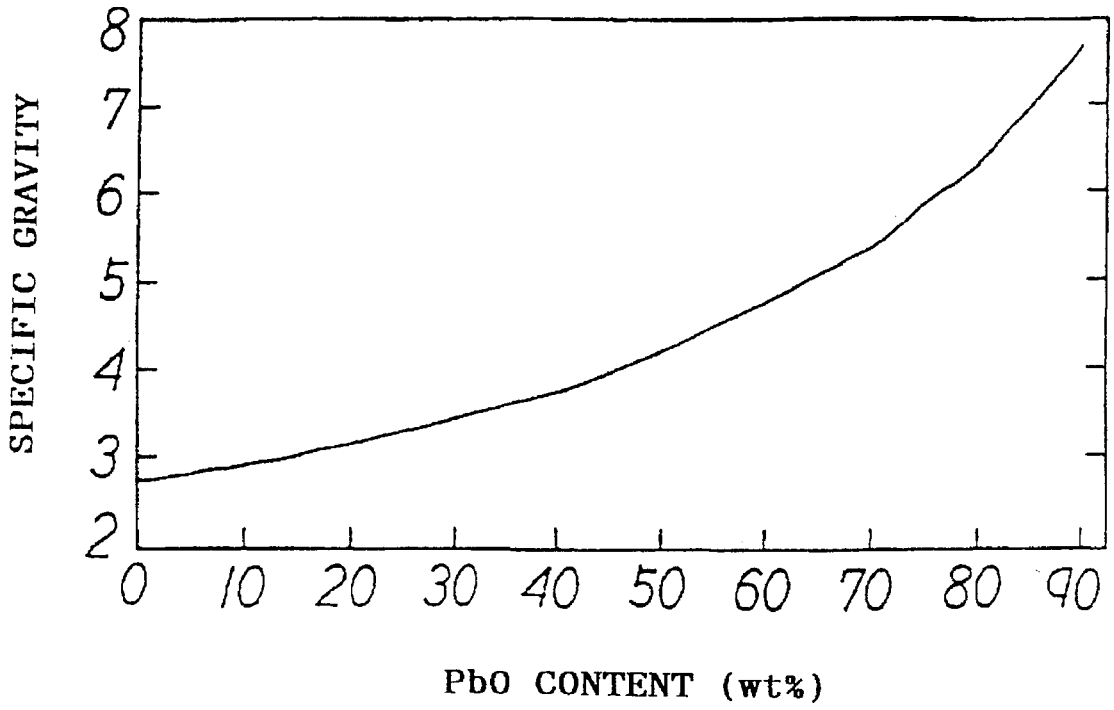
FIG. 2 is a diagram showing changes of the specific gravity of borosilicate glass in relation to PbO content.

Changes of the specific gravity of the borosilicate glass in relation to PbO content are shown in FIG. 2. In FIG. 2, the axis of abscissas denotes the PbO Content (wt. %: weight percent) in the glass composition, and the axis of ordinates denotes the corresponding changes of the specific gravity of the glass. As seen from the diagram, as the PbO content increases, the specific gravity of the glass becomes higher. For example, when alumina having a specific gravity of 3.9 is used as the filler 12, by setting the PbO content to 45 wt. % or more, the specific gravity of the glass 11 can be set to 3.9 or more. However, if the PbO content exceeds 90 wt. %, solidification by baking does not occur, and it cannot be used as the protective layer 10. In addition, as the PbO content increases, the baking temperature and softening point tend to decline. More specifically it is when the PbO content is about 50 wt. % or more that the preferred baking temperature of 600° C. and softening point of 550° C. are obtained in the case where Al is used as the electrodes 9. Consequently, a preferred PbO content is 45 to 90 wt. %, and in consideration of the specific gravity and sintering performance, it is more preferable to set to 60 to 85 wt. %.

As the filler 12 to be dispersed in the glass 11 of the protective layer 10, aside from the alumina ($Al_2O_3$) noted above, diamond, quartz ($SiO_2$), tantalum oxide ($Ta_2O_5$), and others may be also used. For example, the hardness and thermal conductivity of alumina used as the filter 12 are given in the following in comparison with those of the borosilicate glass:

[Vickers hardness]
borosilicate glass: Approx. 300 kg/mm$^2$
alumina: Approx. 1,500 kg/mm$^2$

[Thermal conductivity]
borosilicate glass: Approx. $2\times10^{-3}$ cal/cm.sec.°C.
alumina: Approx. $5\times10^{-3}$ cal/cm.sec. °C.

As seen from the above, by containing alumina filler 12 in the glass 11, the hardness and thermal conductivity of the glass can be enhanced. Moreover, the comparison of the thermal expansion coefficient of borosilicate glass containing 15 wt. % alumina filler with that of borosilicate glass containing no alumina filler are as follows:

[thermal expansion coefficient]
no alumina filler: Approx. $60\times10^{-7}$/°C.
15 wt. % alumina filler: Approx. $40\times10^{-7}$/° C.

Hence, by reducing the thermal expansion coefficient of the glass 11, the thermal stress due to heat pulse from the resistance heating element 8 can be lowered, and the pulse resistance can be enhanced.

The shape of the filler 12 may be granular, spherical, fibrous or polygonal, and in order not to lower the smoothness of the surface of the protective layer 10 when the filler 12 is present more near the surface of the protective layer 10, it is preferable that the filler 12 in the invention has the mean particle size of about 0.5 μm or less. That is because, even if the filler 12 is present on the surface of the protective layer 10, more than half of the particles of the filler 12 may not project to the surface, and the surface roughness Ra of the protective layer 10 is less than half the projection, and therefore when the mean particle size of the filler 12 is about 0.5 μm or less, a favorable recording characteristic may be obtained by keeping the surface roughness Ra of the protective layer 10 around 0.1 μm or less. The content of the filler 12 in the protective layer 10 is preferably set in a range of 5 to 35 wt. %. If less than 5 wt. %, effects of the filler 12 such as increase of wear resistance and thermal conductivity and decrease of coefficient of thermal expansion can not obtained. On the other hand, if exceeding 35 wt. %, the entire filler particles cannot be covered by the glass, and the protective layer 10 ends to be fragile.

The protective layer 10 formed of the glass 11 containing the filler 12 is formed so as to cover the resistance heating element 8 and its neighboring electrodes 9. The thickness of the protective layer 10 is preferably set at about 3 to 14 μm, and more preferably at 7 to 10 μm, in the light of sufficient mechanical strength for withstanding sliding on the recording paper and smooth transfer of heat from the resistance heating element 8 to the recording paper. If the thickness is smaller than about 3 μm, the mechanical strength is insufficient, and if the thickness being larger than about 14 μm, heat conduction is not proper.

Herein, if the thickness of the protective layer 10 is smaller than about 7 μm, the difference between the thickness of the protective layer 10 on the resistance heating element 8 and the thickness of the protective layer 10 on the electrodes 9 becomes relatively large, and thermal stress due to heat pulses from the resistance heating element 8 is concentrated in the step portion where the protective layer 10 changes in level, and the pulse resistance of the heating unit may be insufficient.

Hence, according to the invention, in order to enhance the pulse resistance and prevent deterioration caused by oxidation of the resistance heating element 8 and electrodes 9 or reaction of the protective layer 10 with components of the glass 11 in forming the protective layer 10, and also to decrease electric resistance value chances of the resistance heating element 8, it is proposed in the thermal head 6 of the above constitution to interpose a deterioration preventive layer formed of oxide and/or nitride between both the resistance heating element 8 and the electrodes 9, and the protective layer 10. The constitution of an embodiment of a thermal head of the invention is shown in FIGS. 3A through 3C.

Figure 3A:
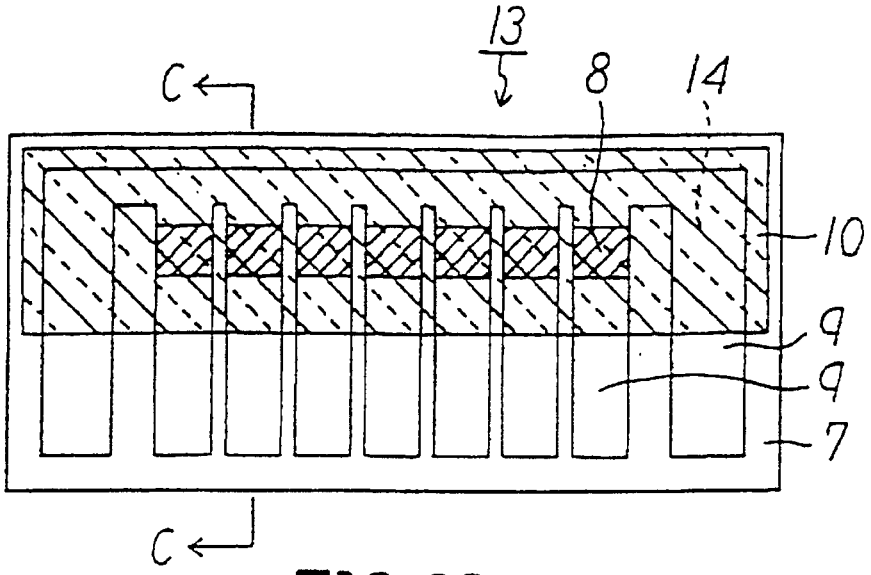
FIG. 3A is a plan view showing the constitution of another embodiment of a thermal head of the invention.
Figure 3B:
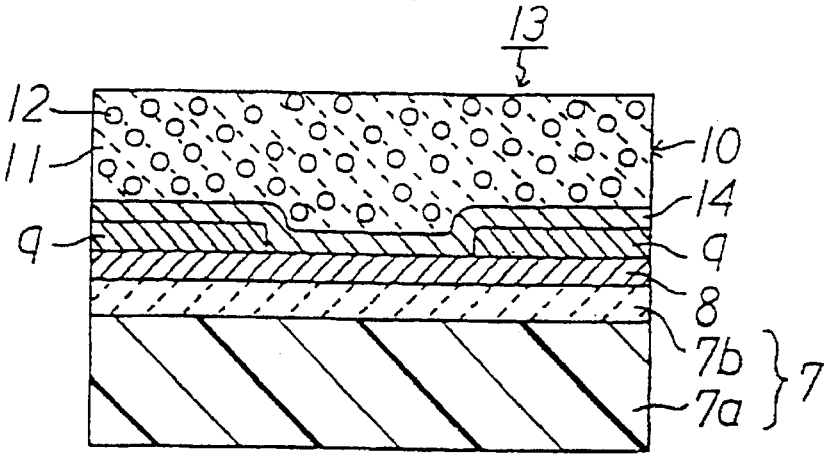
FIGS. 3B and 3C are essential sectional views taken along plane C—C.
Figure 3C:
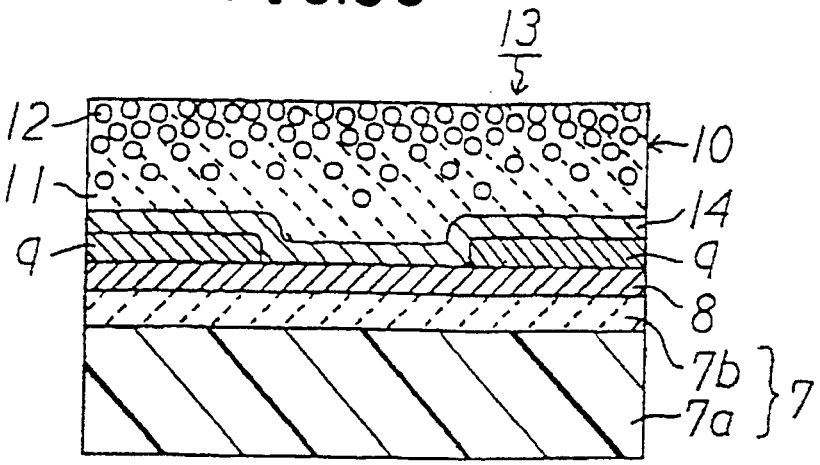

FIGS. 3A through 3C shows an example of a line head similar to the one as shown in FIGS. 1A through 1C, in which FIG. 3A is a plan view, and FIG. 3B an 3C are essential sectional views taken along plane C—C. In FIGS. 3A through 3C, the same parts as in FIGS. 1A through 1C are identified with the same reference numerals.

In a thermal head 13 shown in FIGS. 3A through 3C, a resistance heating element 8 and electrodes 9 are formed on an electrically insulating substrate 7 wherein a glaze layer 7*b* is formed on a ceramic substrate 7*a*. The formation sequence may be reversed as shown in FIG. 5C. A protective layer 10 is formed so as to cover the resistance heating element 8 and electrodes 9, and this protective layer 10 is formed of filler-containing-glass having a filler 12 dispersed in glass 11. Between the resistance heating element 8 and the protective layer and between the electrodes 9 and the protective layer 10, a deterioration preventive layer 14 formed of oxide and/or nitride is interposed.

In this thermal head 13, the specific gravity of the glass 11 or forming the protective layer 10 is also set to be almost equal to or larger than the specific gravity of the filler 12, and when the specific gravity of the glass 11 is almost equal to the specific gravity of the filler 12, as shown in FIG. 3B, a proper amount of the filler 12 can be distributed almost uniformly in all the protective layer 10, even near the surface. When the specific gravity of the glass 11 is larger than that of the filler 12, as shown in FIG. 3C, the filler 12 of high hardness can be distributed more near the surface of the protective layer 10.

As the deterioration preventive layer 14 of the invention, an oxide and/or a nitride is used, for example, the oxide includes silicon oxide ($SiO_2$), alumina ($Al_2O_3$) and tantalum oxide ($Ta_2O_5$), and the nitride include silicon nitride (SiN). The mixture of oxide and nitride includes SiAlON, and their mixture or laminate may be used.

The deterioration preventive layer 14 of such materials may be formed especially by a thin film forming method such as the sputtering method and the CVD method, so that the one of high density and high hardness which has stable characteristics and is excellent in adhesion may be obtained. The thin film forming technique preferable for forming the deterioration preventive layer 14 of the invention includes various sputtering methods such as the RF (rasio frequency) sputtering method, DC (direct current) sputtering method, reactive sputtering method, RF magnetron sputtering method, and DC magnetron sputtering method, various CVD methods such as the plasma CVD method, heat CVD method, and light CVD method, and various deposition methods such as the ion plating method, vacuum deposition method, resistance heating deposition method, electron beam deposition method, laser beam deposition method, and active reaction deposition method.

By heating the deterioration preventive layer 14 formed by such a thin film forming technique for about 120 minutes at 300° C. to 400° C., an extremely thin oxide film is formed on the surface OF the deterioration preventive layer 14, and not only the affinity of the deterioration preventive layer 14 and protective layer 10 is enhanced, and when baking the protective layer 10, but also it is effective to prevent bubble generation in the protective layer 10 due to a rapid oxidation reaction of the deterioration preventive layer 14 with the oxygen contained in the protective layer 10. Thus the protective layer 10 can be firmly adhered to the deterioration preventive layer 14, and the mechanical strength of the protective layer 10 can be also enhanced.

Figure 4:
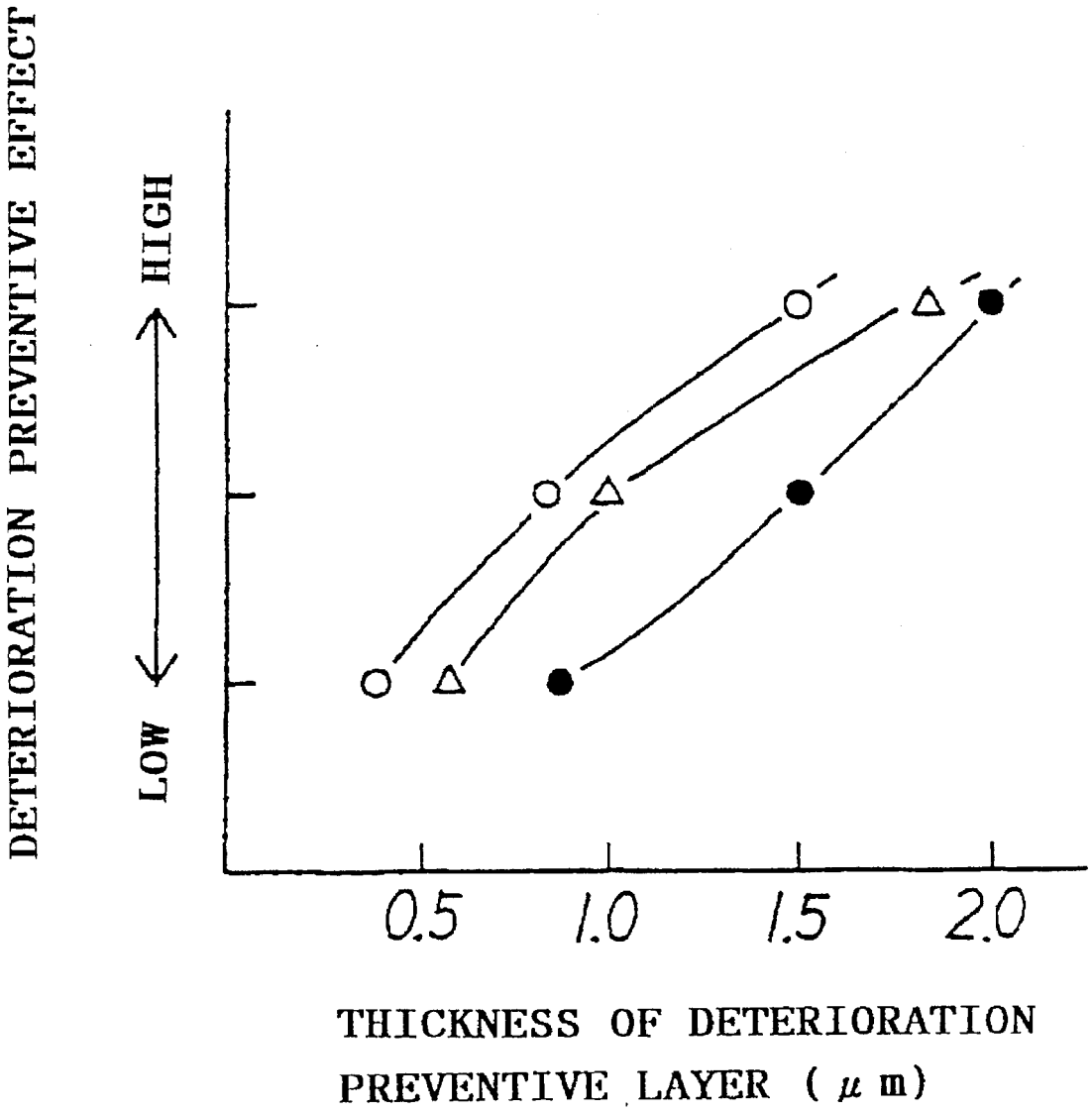
FIG. 4 is a diagram showing the relation between thickness of deterioration preventive layer and its effect in the thermal head of the invention.

As seen from the relation between the thickness and effect of the deterioration preventive layer shown in FIG. 4, the thickness of the deterioration preventive layer 14 may be set properly depending on the type of the deterioration preventive layer 14. FIG. 4 is a diagram showing the relation between the thickness and deterioration preventive effect in various types of deterioration preventive layer 14, in which the axis of abscissas denotes the thickness of the layer 14, and the axis of ordinates represents the relative magnitude of the deterioration preventive effect. Besides, in the diagram, a dark circle "●" refers to the oxide, a white circle "○" means the nitride, and a triangle "Δ" shows the mixture of oxide and nitride. The curves linking the marks are the individual characteristic curves.

As seen from FIG. 4, when using an oxide for the deterioration preventive layer 14, the thickness thereof may be set a little larger because the oxide contains oxygen atoms, that is, 0.08 μm or more, preferably 0.15 μm or more, and more preferably 0.20 μm or more. When using a nitride, the antioxidant effect is great because of no oxygen atoms, and the thickness may be 0.04 μm or more, preferably 0.08 μm or more, or more preferably 0.15 μm or more. In the case of a mixture of an oxide and a nitride, an intermediate thickness may be enough, that is, 0.06 μm or more, preferably 0.10 μm or more, or more preferably 0.18 μm or more. If smaller than these thicknesses, the pulse resistance tends to be insufficient.

On the other hand, if the thickness of the deterioration preventive layer 14 exceeds 2 μm, although there is no particular problem in aspects of characteristic and technic, the manufacturing cost becomes high. That is, when forming the deterioration preventive layer 14 by a thin film forming technique, its film forming speed is relatively slow. Considering application into mass production, it is not preferred to spend more than an hour in forming the film because that leads to increase of manufacturing cost. The speed of forming a film of oxide by thin film forming technique, for example, $SiO_2$ is about 0.011 μm/min, and hence the thickness of this layer 14 is preferred to be about 0.66 μm or less, and the speed of forming a film of nitride, for example, SiN is about 0.024 μm/min, and it is preferred to be about 1.44 μm or less. In the case of a mixture of an oxide and a nitride, for example, SiAlON, it is preferred to be about 1.11 μm or less. The thickness of the deterioration preventive layer 14 is set properly in such a range depending on the required characteristics such as durability of the thermal head 13.

Practical examples of thermal head of the invention are described below.

EXAMPLE 1

The thermal head of the invention structured as shown in FIG. 1 was fabricated in the following manner. First, a resistance heating element 8 of TaN having a thickness of about 0.05 μm was formed by a sputtering method on a glazed ceramic substrate 7 wherein a borosilicate glass glaze layer *7b* was formed on the surface thereof, and an Al layer having a thickness of about 1 μm was formed thereon by the electron beam deposition method, and electrodes 9 having a predetermined electrode wiring pattern were formed by the photolithographic process.

On the other hand, as the glass 11 for forming the protective layer 10, borosilicate glass powder having a composition of $SiO_2$: 15% , PbO: 70%, $B_2O_3$: 5%, and ZnO : 4% was prepared, and alumina particles having a mean particle size of 0.5 μm were prepared as the filler 12. The specific gravity and softening point of the glass 11 were 5.3 and 490° C., respectively. Fifteen wt. % alumina particles were blended to the glass powder, and additionally a vehicle was added to knead into paste. The paste was printed to cover the resistance heating element 8 and electrodes 9 by a screen printing method, and baked for 10 minutes at 530° C. to form the protective layer 10 of filler-containing-glass having a thickness of 7 μm, thereby a thermal head HA of the invention being completed.

The distribution state of the filler 12 in the protective layer 10 of the thermal head HA was investigated by observing the section of the protective layer 10 with a electron microscope, and the filler 12 was found to be distributed much on the surface of the protective layer 10, and distributed less at the side of the resistance heating element 8 and electrodes 9. The surface roughness Ra of the protective layer 10 was measured by a probe surface roughness meter, and a favorable smoothness of 0.1 μm was confirmed.

Using this head HA, image recording was tested by an image recording testing apparatus, and the image quality was evaluated. Print densities of 1.1 or more, and a sufficient recording density were achieved without vague or blurry print, and the protective layer 10 was excellent in thermal conductivity. Furthermore, the wear resistance of the protective layer 10 was evaluated by a lifetime testing machine through long term actual printing, and the wear loss after actual print extending over a length of 30 km was only 2 μm. Thus it was confirmed that the protective layer 10 is excellent in wear resistance. In actual print of 30 km, $3\times10^7$ pulses were applied to the resistance heating element 8, and as a result no dot dropout or defect was observed, and a sufficient heat resistance was also confirmed.

EXAMPLE 2

First, in the same manner as in Example 1, electrodes 9 and a resistance heating element 8 were formed on a glazed ceramic substrate 7. Next, as the glass 11 for forming the protective layer 10, lead borosilicate glass powder having a composition of $SiO_2$: 30%, PbO: 45%, $B_2O_3$: 8% , and ZnO: 8% was prepared. The specific gravity and softening point of the glass 11 were about 3.9 and about 590° C., respectively. As the filler 12, alumina particles having a mean particle size of 0.5 μm and a specific gravity of 3.9 were prepared.

To this glass powder, 15 wt. % alumina filler was added, and additionally a vehicle was added to knead into paste. The paste was printed to cover the resistance heating element 8 and electrodes 9 by a screen printing method and heated for 10 minutes at 640° C. to form the protective layer 10 of filler-containing glass having a thickness of 7 μm, thereby a thermal head HB of the invention being completed.

The distribution state of the filler 12 in the protective layer 10 of the thermal head HB was investigated in the same way as in Example 1, and a uniform distribution over the entire protective layer 10 was confirmed. The surface of the protective layer 10 was excellent in smoothness, with a surface roughness Ra of 0.08 μm.

Also in the same way as in Example 1, evaluation of image quality, wear resistance, and heat resistance were conducted in the thermal head HB, and all results were favorable without problems.

EXAMPLE 3

In the following manner was fabricated a comparative example of thermal head in which the constitution is the same as that of Examples 1 and 2 and the specific gravity of the glass 11 is smaller than that of the filler 12.

First, the same as in Example 1, electrodes 9 and resistance heating element 8 were formed on a glazed ceramic substrate 7. As the lass 11 for forming the protective layer 10, lead borosilicate glass powder having a composition of $SiO_2$: 40%, PbO: 20%, $B_2O_3$: 15%, and ZnO: 15% was prepared, and as the filler 12, alumina powder having a mean particle size of 0.5 μm and a specific gravity of 3.9 was prepared. The specific gravity and softening point of the glass 11 were about 3.2 and about 690° C., respectively.

To this glass powder, 15 wt. % alumina filler was added, and additionally a vehicle was added to knead into paste. The mixture was printed to cover the resistance heating element 8 and electrodes 9 by a screen printing method, and heated for 10 minutes at 740° C. to form the protective layer 10 of filler-containing-glass having a thickness of 7 μm, thereby a thermal head HC of the comparative example being completed.

The distribution state of the filler 12 in the protective layer 10 of the thermal head HC was investigated in the same way as in Example 1, and the filler 12 was found to be distributed more in the vicinity of the resistance heating element 8 and electrodes 9.

In the same way as in Example 1, the image quality was evaluated, and initially a satisfactory print density of 1.1 was obtained without vague or blurry print. However, in a lifetime test through long term actual printing, the wear loss was 4 μm after running of 30 km, and an extreme wear loss was noted. On the surface of the heating unit, multiple running laws were detected, and cracks were found in the protective layer 10. Furthermore, out of 1,728 resistance heating elements per head, the resistance value of eight resistance heating elements was drifted by 15% or more, and hence dot dropout was noted in the print.

EXAMPLE 4

In this example, a thermal head of the invention structured as shown in FIG. 3 was fabricated in the following manner. First, on a glazed ceramic substrate 7 forming a lead borosilicate glass glaze layer 7b on the surface, a resistance heating element 8 of TaSiO having a thickness of about 0.05 μm was formed by the RF sputtering method, and an Al layer having a thickness of about 1 μm was formed thereon, and a resistance heating element 8 and a wiring pattern of electrodes 9 were formed by photolithographic process. On the resistance heating element 8 and electrodes 9, a deterioration preventive layer 14 of SiAlON having a thickness of 0.3 μm was formed by the RF sputtering method.

On the other hand, as the glass 11 for forming the protective layer 10, lead borosilicate glass powder having a composition of $SiO_2$: 15%, PbO: 70%, $B_2O_3$: 5%, and ZnO: 4% was prepared, and alumina particles having a mean particle size of 0.5 μm were prepared as the filler 12, The specific gravity and softening point of the glass 11 were about 5.3 and 490° C., respectively. To the glass particles, 15 wt. % alumina particles were blended, and additionally a vehicle was added to knead into paste. The paste was printed to cover the resistance heating element 8, electrodes 9 and deterioration preventive layer 14 by a screen printing method, and baked for 10 minutes at 530° C. to form the protective layer 10 of filler-containing-glass having a thickness of 7 μm, thereby a thermal head HD of the invention being completed.

Besides, a thermal head HE of the invention was fabricated in the same manner except that the deterioration preventive layer 14 was formed using silicon nitride (SiN) having a thickness of 0.2 μm.

In these thermal heads HD and HE, the distribution state of the filler 12 in the protective layer 10 and surface roughness Ra of the protective layer 10 were investigated in the same way as in Example 1, and the filler 12 was confirmed to be distributed more on the surface of the protective layer 10, and distributed less in the vicinity of the resistance heating element 8 and electrodes 9, and the surface roughness Ra was 0.1 μm, and a favorable smoothness was observed.

Moreover, deterioration of the resistance heating element 8 and electrodes 9 caused by baking of protective layer 10 was evaluated by an electric resistance change rate between before and after formation of the protective layer 10, determined by measuring the resistance value between the common electrode and the individual electrodes 9 and appearance observation, and the results as shown in Table 1 were obtained. In Table 1, the results of the thermal head HF fabricated in the same manner as that of the other examples except that deterioration preventive layer 14 was not formed are also listed as a comparative example.

As seen from the result in Table 1, in the thermal heads HD and HE of the invention wherein the deterioration preventive layer 14 was formed, the resistance change rate were as small as 3.2% and 2.5%, respectively, and the appearance observation also presented favorable results without darkening of electrodes or the like. By contrast, in the head HF of the comparative example not including the deterioration preventive layer 14, the resistance change rate was very large, which ranges from 200 to 300%, and the electrodes were darkened, and the results were considerably inferior. It was confirmed from these results that, in the thermal heads HD and HE of the invention, deterioration of the resistance heating element 8 and electrodes 9 was considerably suppressed by the deterioration preventive layer 14.

Using these heads HD and HE, the image quality and wear resistance were evaluated in the same way as in Example 1, and in both samples, the print density was 1.1 or more, without vague or blurry print, and the thermal conductivity of the protective layer 10 was excellent. The wear resistance was also superior, namely wearing loss was only 2 μm attar running of 30 km.

In actual printing of 30 km, $3\times10^7$ pulses were applied to the heating element 8, and the result was that no dropout was found and a sufficient heat resistance was also obtained.

The foregoing embodiments relate to examples of the line head, but the invention is not limited to this alone, but may be applied to a serial head, and the same operation and effects are obtained.

In the thermal heads of the embodiments, when forming the resistance heating elements and electrodes by a thick film forming technique such as screen printing, a smooth layer made of glass or the like may be interposed between the resistance heating element and the protective layer and between the electrodes and the protective layer, and in this case, in addition to the same effects as in the foregoing embodiments, the surface smoothness of the protective layer is further enhanced and contact with recording paper in printing can be improved. Such smooth layer may be formed using glass paste having a larger shrinkage rate (e.g., 88%) than the glass paste for forming the protective layer (shrinkage rate: 56%), and it is applied on a thick film by hitherto known screen printing or the like, and dried, and baked simultaneously with baking the protective layer of glass.

Furthermore, in the embodiments, the filler in the protective layer is concentrated near the surface of the protective layer, but instead, the filler in the protective layer may be also distributed so as to increase gradually from the resistance heating element side toward the surface side.

According to the invention, as described specifically herein, in the thermal head having the protective layer formed of filler-containing-glass, by improving the disper-

TABLE 1

| Thermal head | HD | HE | HF |
|---|---|---|---|
| Resistance heating element material | TiSiO | TiSiO | TiSiO |
| Electrode material | Al | Al | Al |
| Deterioration preventive layer material | SiAlON | SiN | none |
| Protective layer baking temperature | 530° C. | 530° C. | 530° C. |
| Resistance change rate | 3.2% | 2.5% | 200–300% |
| Appearance observation result | No change | No change | Electrode darkened |

sion and distribution of the filter in the glass, the wear resistance is enhanced while maintaining the smoothness of the protective layer surface, and the wear loss caused by sliding on the recording paper is decreased. In addition, by reducing the thermal expansion coefficient of the protective layer to decrease thermal stress caused by pulse heat generation from the resistance heating element, and further improving the thermal conductivity of the protective layer, a highly reliable thermal head capable of obtaining an excellent recorded image quality for a long period can be provided.

Further according to the thermal head of the invention, if the protective layer of filler-containing-glass is formed, oxidation or other deterioration does not occur in the resistance heating element, and hence a highly reliable thermal head capable of obtaining excellent recorded picture quality for a long time could be provided.

Still further according to the thermal head of the invention, by forming a protective layer of low cost having an excellent wear resistance and stable characteristics, the highly reliable and inexpensive thermal head can be provided.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning an the range of equivalency of the claims are therefore intended to be embraced therein.

What is claimed is:

1. A thermal head, comprising:

a resistance heating element, an electrically insulating substrate, electrodes formed on the electrically insulating substrate for feeding electric power to the resistance heating element, and a protective layer covering the resistance heating element and the electrodes, the protective layer comprising filler-containing-glass, the glass having a specific gravity and the filler having a specific gravity, the specific gravity of the glass being not less than the specific gravity of the filler.

2. The thermal head of claim 1, comprising:

a deterioration preventive layer interposed between at least one of the resistance heating element and the protective layer and between the electrodes and the protective layer, the deterioration preventive layer comprising at least one of an oxide and a nitride.

3. A thermal head, comprising:

a resistance heating element, an electrically insulating substrate, electrodes formed on the electrically insulating substrate for feeding electric power to the resistance heating element, and a protective layer covering the resistance heating element and the electrodes, the protective layer comprising filler-containing-glass and defining an upper half and a lower half, wherein there is more filler present in the upper half of the protective layer than in the lower half of the protective layer.

* * * * *